US009527106B2

(12) United States Patent
Ngu et al.

(10) Patent No.: US 9,527,106 B2
(45) Date of Patent: Dec. 27, 2016

(54) APPLICATOR AND METHOD FOR DISPENSING A VISCOUS FLUID

(71) Applicant: Nordson Corporation, Westlake, OH (US)

(72) Inventors: Peter Ngu, Bordentown, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/516,886

(22) Filed: Oct. 17, 2014

(65) Prior Publication Data

US 2015/0114986 A1 Apr. 30, 2015

Related U.S. Application Data

(60) Provisional application No. 61/898,092, filed on Oct. 31, 2013.

(51) Int. Cl.
*B05C 17/01* (2006.01)
*B05C 17/005* (2006.01)

(52) U.S. Cl.
CPC ... *B05C 17/00566* (2013.01); *B05C 17/00553* (2013.01); *B05C 17/00576* (2013.01); *B05C 17/00583* (2013.01); *B05C 17/01* (2013.01); *B05C 17/00596* (2013.01); *B05C 17/0116* (2013.01)

(58) Field of Classification Search
CPC ..... B05C 17/00566; B05C 17/00553; B05C 17/00576; B05C 17/00583; B05C 17/01; B05C 17/00596; B05C 17/0116
See application file for complete search history.

(56) References Cited

U.S. PATENT DOCUMENTS 3,029,983 A 4/1962 Wagenhals
3,266,671 A 8/1966 Gelpey
(Continued)

FOREIGN PATENT DOCUMENTS

DE 9100054 U1 4/1991
DE 102011010763 A1 8/2012
(Continued)

OTHER PUBLICATIONS

European Patent Office, European Search Report in EP Application No. 14190545, Apr. 10, 2015.

*Primary Examiner* — Frederick C Nicolas
(74) *Attorney, Agent, or Firm* — Baker & Hostetler LLP

(57) ABSTRACT

An applicator for dispensing a first viscous fluid includes a support structure, a cartridge including a first wall and a first interior space. The first interior space receives a first collapsible tube holding the first viscous fluid. The first collapsible tube is formed from a flexible material and has a length with generally opposite sidewall portions defined along the length. The first collapsible tube is positioned against the first wall and further includes a closed end and a dispensing end. An actuator is operatively coupled to the support structure and moves through the interior space of the cartridge along the length of the collapsible tube and against one of the generally opposite sidewall portions to compress the one generally opposite sidewall portion against the other sidewall portion along the length and squeeze the viscous fluid from the dispensing end.

19 Claims, 10 Drawing Sheets

(56) References Cited

U.S. PATENT DOCUMENTS

| | | | | |
|---|---|---|---|---|
| 3,323,682 | A | | 6/1967 | Creighton, Jr. et al. |
| 3,325,057 | A | * | 6/1967 | Watson, Jr. ..... B65D 35/28 222/103 |
| 5,184,757 | A | | 2/1993 | Giannuzzi |
| 5,332,122 | A | * | 7/1994 | Herold ..... B05C 17/00509 222/105 |
| 5,375,740 | A | | 12/1994 | Umetsu et al. |
| 5,425,475 | A | | 6/1995 | Clark |
| 5,667,102 | A | * | 9/1997 | Keller ..... B05B 11/0045 222/327 |
| 5,697,524 | A | | 12/1997 | Sedlmeier |
| 5,993,720 | A | | 11/1999 | Konuma et al. |
| 6,158,621 | A | | 12/2000 | Keller |
| 6,484,904 | B1 | | 11/2002 | Horner et al. |
| 7,934,864 | B2 | | 5/2011 | Heusser et al. |
| 8,042,926 | B2 | | 10/2011 | Ostermeier et al. |
| 2010/0108709 | A1 | | 5/2010 | Frey |
| 2012/0104030 | A1 | | 5/2012 | Springhorn et al. |
| 2012/0267394 | A1 | | 10/2012 | Pierson et al. |
| 2012/0279988 | A1 | | 11/2012 | Hiemer |
| 2013/0026182 | A1 | | 1/2013 | Habibi-Naini |
| 2013/0087578 | A1 | | 4/2013 | Brem et al. |

FOREIGN PATENT DOCUMENTS

| | | | |
|---|---|---|---|
| EP | 2277800 | A1 | 1/2011 |
| EP | 2447184 | A1 | 5/2012 |
| WO | 2011131483 | A1 | 10/2011 |

* cited by examiner

APPLICATOR AND METHOD FOR DISPENSING A VISCOUS FLUID

CROSS-REFERENCE TO RELATED APPLICATION

This application claims the benefit of Application Ser. No. 61/898,092, filed Oct. 31, 2013, the disclosure of which is hereby incorporated by reference herein.

TECHNICAL FIELD

The present invention relates generally to an applicator for dispensing a viscous fluid and, more particularly, dispensing a first viscous liquid and a second viscous liquid.

BACKGROUND

Dispensing systems are commonly used for dispensing one or more fluids from containers. A well known example of such a dispensing system is a caulking gun that is used to dispense caulk from a caulk container having a generally rigid and tubular body. Other types of containers also exist, and are used with appropriate dispensing systems. For example, a so-called "sausage pack" container is a flexible and collapsible fluid container which somewhat resembles a sausage having a skin surrounding its internal contents. This type of collapsible container or tube is typically generally cylinder shaped, and includes a fluid enclosed by a flexible membrane. Collapsible containers can be used to contain adhesives, for example. Once all of the fluid has been extracted from a collapsible container, its membrane can be collapsed to occupy a much smaller volume than when it was full, thereby making it a desirable packaging option.

There is a continuing need for new and improved devices relating to dispensing fluids from collapsible containers or tubes.

SUMMARY

In one illustrative embodiment, the invention provides an applicator for dispensing a first viscous fluid. The applicator includes a support structure and a cartridge including a first wall and a first interior space. The first interior space receives a first collapsible tube holding the first viscous fluid. The first collapsible tube is formed from a flexible material and has a length with generally opposite sidewall portions defined along the length. The first collapsible tube is positioned against the first wall and further includes a closed end and a dispensing end. An actuator is operatively coupled to the support structure. The actuator is movable through the interior space of the cartridge along the length of the collapsible tube and against one of the generally opposite sidewall portions to compress the one generally opposite sidewall portion against the other sidewall portion along the length and squeeze the viscous fluid from the dispensing end.

The applicator may have various additional aspects as further summarized below. For example, the opposite sidewall portions have a uniform thickness greater than 0.003 inches. The cartridge further comprises a first rigid tube having the first wall and defining the first interior space sized for receiving the first collapsible tube therein. The first rigid tube has a first distal end and a first proximal end. The cartridge further comprises a first piston sized for insertion into the first interior space. The first piston is movably positioned within the first interior space from the first proximal end toward the first distal end and is configured to flatten the one generally opposite sidewall portion against the other sidewall portion. The cartridge further comprises a gap defined by the first piston and the first rigid tube for receiving the flattened collapsible tube therebetween. The first piston selectively slides over the flattened collapsible tube. The cartridge may alternatively comprise a gap defined by the first piston and the first rigid tube for receiving the flattened collapsible tube therebetween, wherein at least a portion of the first piston selectively rolls over the flattened collapsible tube. The cartridge further comprises a second wall and a second interior space. The second interior space receives a second collapsible tube holding a second viscous fluid. The second collapsible tube is formed from a flexible material and has a length with generally opposite sidewall portions defined along the length. The second collapsible tube is positioned against the second wall and further includes a closed end and a dispensing end. The applicator further comprises a static mixer operatively connected to the cartridge for mixing the first and second viscous fluids.

In still further optional features, the cartridge further includes a second rigid tube having the second wall and defining the second interior space sized for receiving the second collapsible tube therein. The second rigid tube has a first distal end and a first proximal end. A second piston is sized for insertion into the second interior space. The second piston is movably positioned within the second interior space from the second proximal end toward the second distal end and is configured to flatten the one generally opposite sidewall portion against the other sidewall portion. The first and second rigid tubes are positioned side-by-side and rigidly secured together. The cartridge further comprises a slot extending from the first rigid tube to the second rigid tube and extending at least partially along the length of the first and second rigid tube. A carriage member connects the first piston to the second piston through the slot for synchronizing movement of the first and second pistons.

In another illustrative embodiment, the invention provides a cartridge for holding a first viscous fluid. The cartridge includes a first wall and a first interior space. The first interior space receives a first collapsible tube holding the first viscous fluid. The first collapsible tube is formed from a flexible material and has a length with generally opposite sidewall portions defined along the length. The first collapsible tube is positioned against the first wall and further includes a closed end and a dispensing end. A first rigid tube has the first wall and defines the first interior space sized for receiving the first collapsible tube therein. The first rigid tube has a first distal end and a first proximal end. A first piston is sized for insertion into the first interior space. The first piston is movably positioned within the first interior space from the first proximal end toward the first distal end and configured to flatten the one generally opposite sidewall portion against the other sidewall portion. Additional features may be included as otherwise described herein.

In another aspect of the invention, a method of dispensing a first viscous fluid from an applicator is provided. The applicator includes a cartridge with a first collapsible tube within a first interior space of a first rigid tube. The first rigid tube includes a first wall, and the first collapsible tube includes a first sidewall and holds the first viscous fluid. The method comprises moving an actuator through the interior space of the cartridge along a length of the first collapsible tube. A portion of the first sidewall is compressed against an opposite portion of the first sidewall supported by the first wall to flatten at least a portion of the first collapsible tube. A flattened portion of the first collapsible tube is received within a first gap at least partially defined by the first wall within the first interior space. The first viscous fluid is squeezed from a first dispensing end of the first collapsible tube.

The method may further comprise additional aspects. For example, a first piston slides within the first interior space against the first collapsible tube to force the first collapsible tube against the first wall. Alternatively, at least a portion of the first piston rolls within the first interior space against the first collapsible tube to force the first collapsible tube against the first wall.

The cartridge may include a second collapsible tube within a second interior space of a second rigid tube. The second rigid tube includes a second wall, and the second collapsible tube includes a second sidewall and holds a second viscous fluid. The method further comprises moving an actuator through the interior space of the cartridge along a length of the second collapsible tube. A portion of the second sidewall is compressed against an opposite portion of the second sidewall supported by the second wall to flatten at least a portion of the second collapsible tube. A flattened portion of the second collapsible tube is received within a second gap at least partially defined by the second wall within the second interior space. The second viscous fluid is squeezed from a second dispensing end of the second collapsible tube. The first and second viscous fluids may be first and second reactive viscous fluids, and the method further comprises mixing the first and second reactive viscous fluids within a static mixer, and dispensing the mixed viscous reactive fluids from the static mixer.

Various additional features and advantages of the invention will become more apparent to those of ordinary skill in the art upon review of the following detailed description of the illustrative embodiments taken in conjunction with the accompanying drawings.

DETAILED DESCRIPTION

Figure 1:
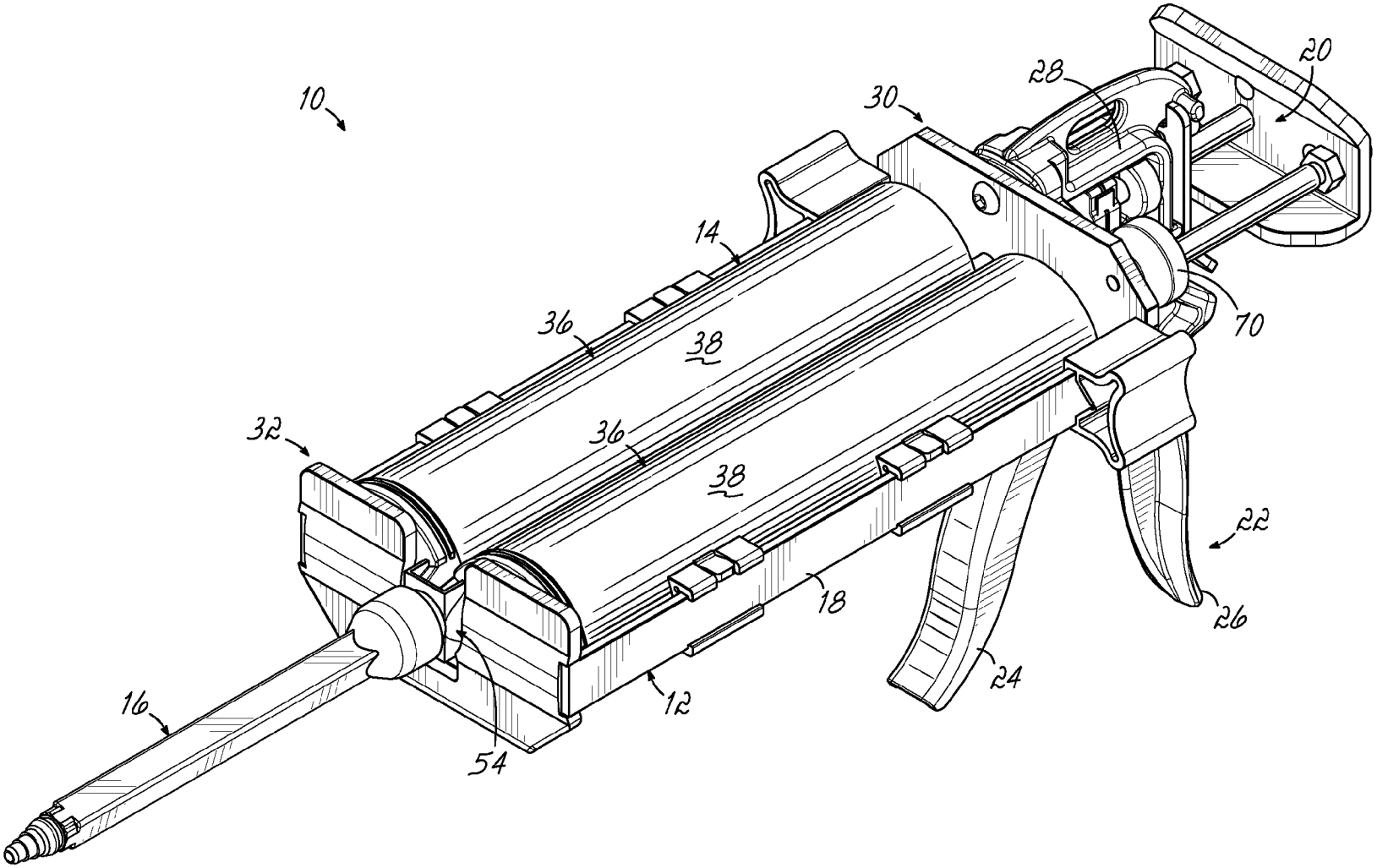
FIG. 1 is a perspective view of a first embodiment of an applicator having a cartridge in accordance with the invention.

With respect to FIG. 1, an exemplary embodiment of an applicator 10 for dispensing one or more viscous fluids, such as adhesive and sealants, includes a dispenser 12, a cartridge 14 removably connected to the dispenser 10, and a nozzle 16. The dispenser 12 generally includes a support structure 18 on which to removably connect cartridge 14, an actuator 20 connected to the support structure 18, and a handle 22 projecting from the support structure 18. The handle 22 includes a trigger 24 that is movable toward a rigid portion 26 of the handle 22 for actuating the actuator 20. More particularly, selectively drawing the trigger 24 toward the rigid portion 26 operatively moves a grip mechanism 28 into engagement with the actuator 20 at a proximal dispenser end portion 30. In turn, a portion of actuator 20 advances toward a distal dispenser end portion 32 and into the cartridge 14 to discharge a first and a second viscous fluid into the nozzle 16. According to an exemplary embodiment, the first and second fluids are reactive and the nozzle 16 is in the form of a static mixer configured to mix and dispense the reactive fluids. Also, it will be appreciated that while the exemplary dispenser 12 is essentially mechanical, it will be appreciated that any other dispenser configured to support the cartridge 14 may be used, such as a pneumatic or electrical dispenser. With respect to the use of the terms "distal" and "proximal," it will be appreciated that such directions and/or locations are intended to describe relative locations longitudinally along exemplary embodiments of the applicator 10. Similarly, a generally longitudinal direction extends along a length of the applicator 10 in either a distal or proximal direction. And a transverse direction extends generally orthogonal to or across the longitudinal direction at any angle. It is not intended that these terms or any other spatial references limit the invention to any of the exemplary embodiments described herein.

Figure 2:
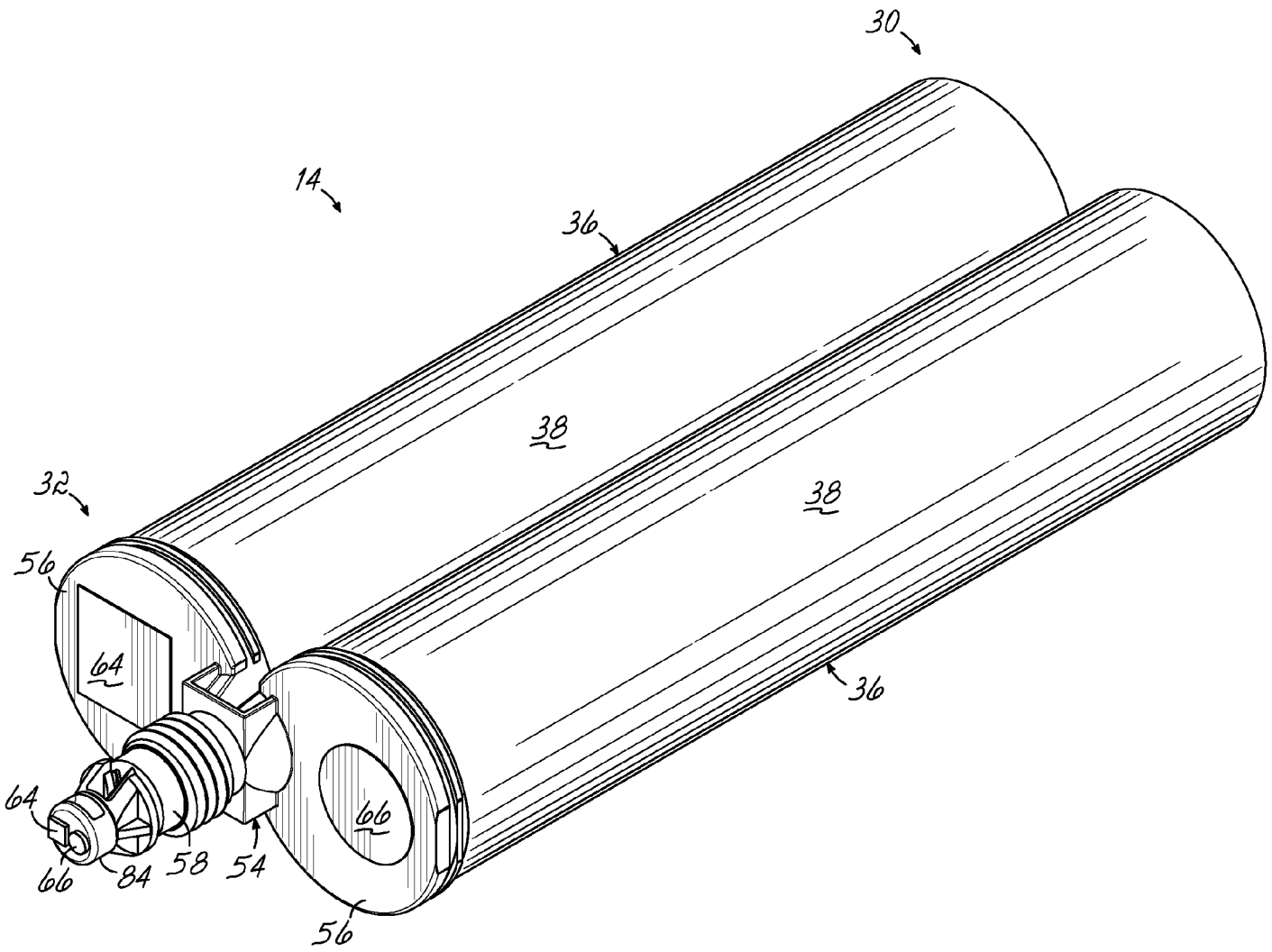
FIG. 2 is a perspective view of the cartridge of FIG. 1.
Figure 3:
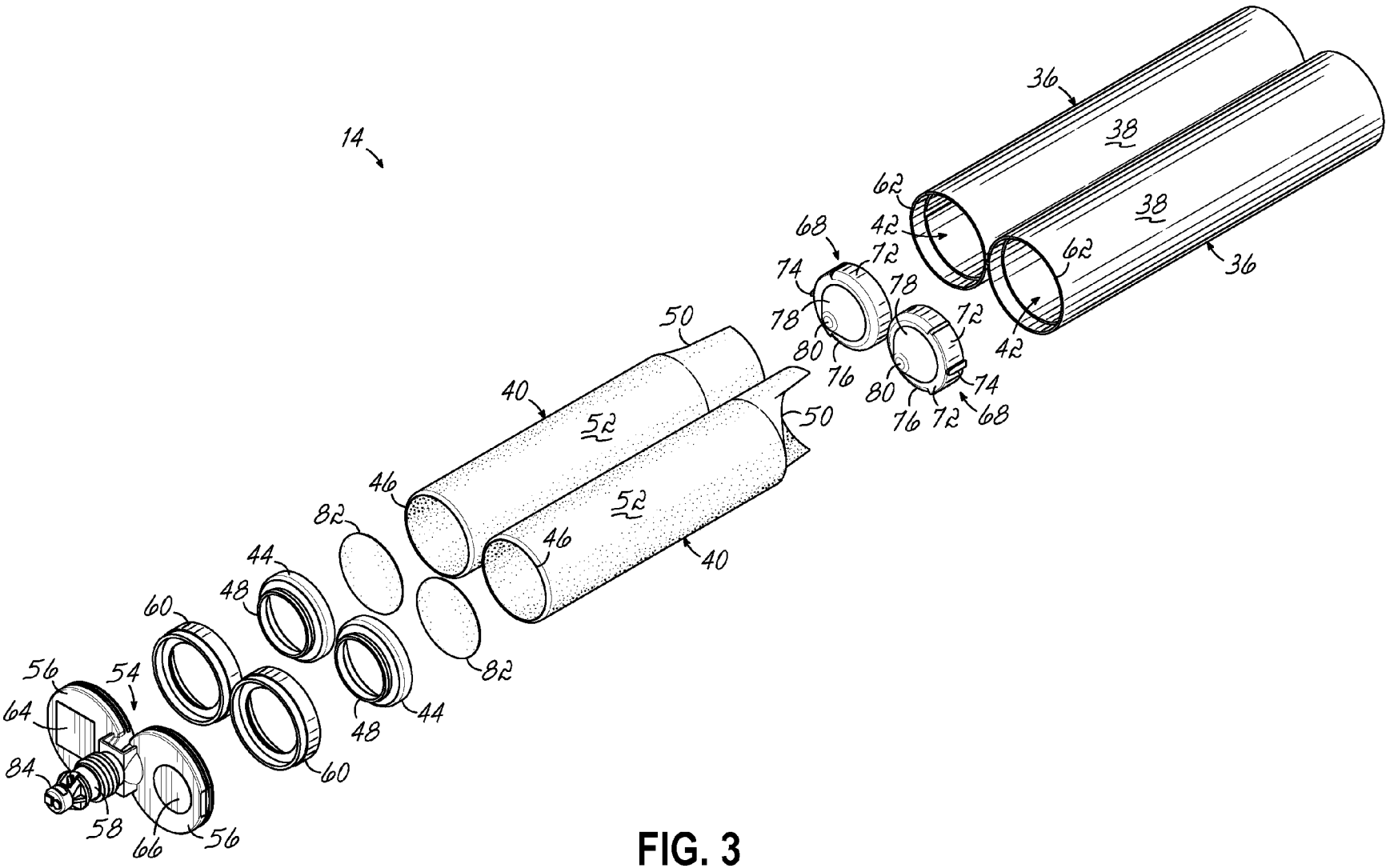
FIG. 3 is an exploded perspective view of the cartridge of FIG. 1.

The cartridge 14 shown in FIG. 2 and FIG. 3 includes a rigid tube 36 secured side-by-side against another rigid tube 36. Each of the rigid tubes 36 has a respective annular sidewall 38 that is rigid for supporting a collapsible tube 40 therein. It will be appreciated that the tube 40 may have any desired shape and configuration, e.g., round cylindrical cross-section, square cross-section, etc. The annular sidewall 38 defines an interior space 42 for receiving one of the respective collapsible tubes 40. According to an exemplary embodiment, each collapsible tube 40 includes a cap 44 about a dispensing end 46 of the collapsible tube 40 that defines an opening 48 for discharging viscous fluid therefrom. In contrast, a closed end 50 of the collapsible tube 40 is positioned opposite from the dispensing end 46. A tube sidewall 52 extends from the cap 44 to the closed end 50. More particularly, the closed end 50 is defined by a first portion of the tube sidewall 52 being sealed against an opposing second portion of the tube sidewall 52. According to an exemplary embodiment, the tube sidewall 52 is manufactured from a flexible material configured to be resistant to permeation from or to an ambient environment. Specifically, the tube sidewall 52 has a generally uniform thickness greater than 0.003 inches and commonly may be from 0.005 inches thick to 0.010 inches thick. The tube sidewall 52 may be any material resistant to permeation such as, but not limited to, plastic, metal, or laminate.

Furthermore, the cartridge 14 includes a manifold 54 for fluidly coupling each collapsible tube 40 to the nozzle 16 (see FIG. 1). The manifold 54 includes a pair of inlet ports 56 and an outlet port 58. According to an exemplary embodiment, each inlet port 56 is further defined by an adapter configured to connect the cap 44 to the inlet port 56. Similarly, the outlet port 58 is configured to connect to the nozzle 16 (see FIG. 1). Thus, with the collapsible tubes 40 within the interior spaces 42, each inlet port 56 rigidly secures to a distal tube opening 62. In addition, manifold 54 also includes a first indicia 64 and a second indicia 66 for indicating the viscous fluid contents of the cartridge 14 to inhibit a user from inadvertently confusing one viscous fluid for another, such as described in U.S. Pat. No. 6,484,904.

Figure 4:
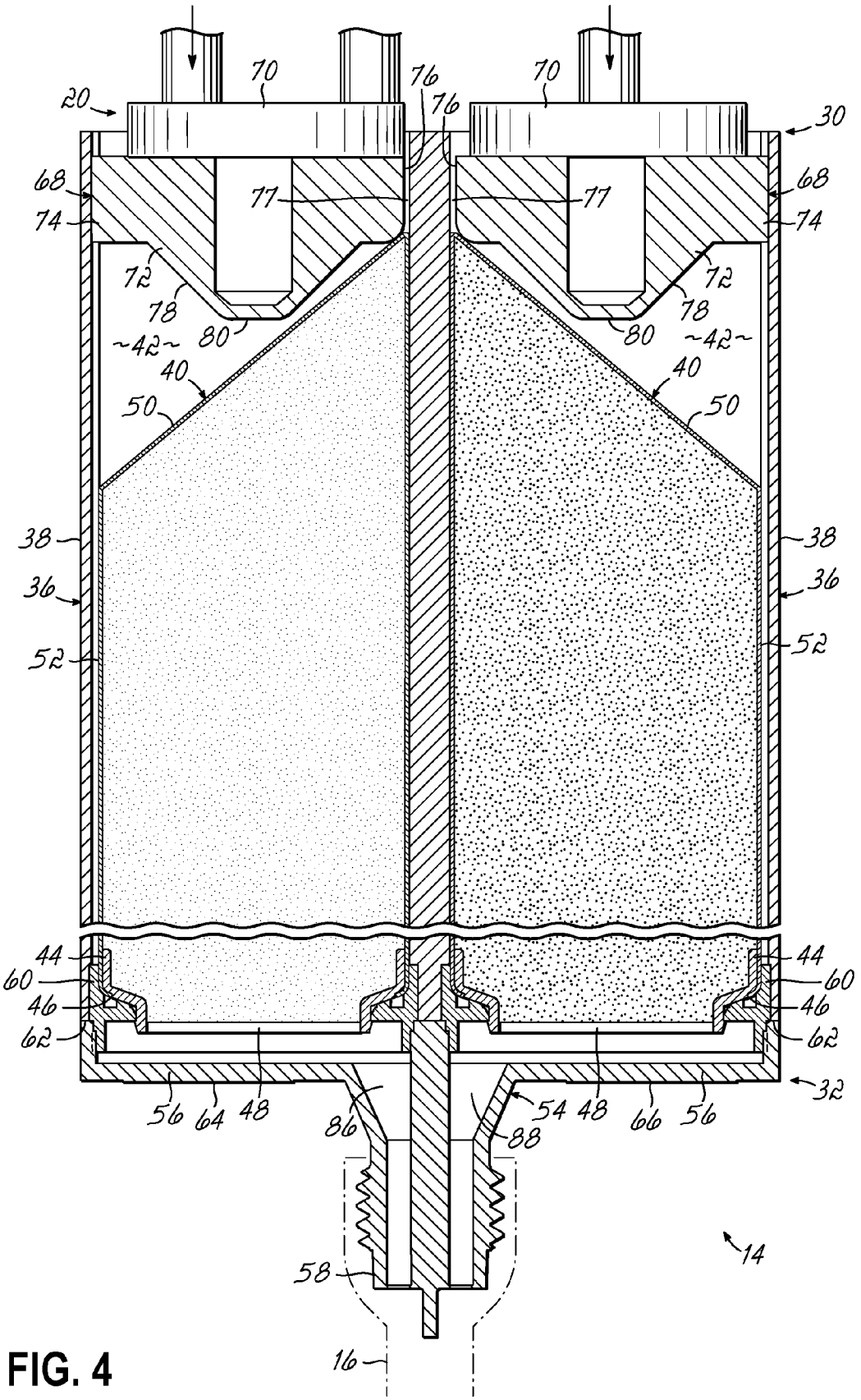
FIG. 4 is a sectional top view of the cartridge of FIG. 1 taken generally along a centerline of the cartridge with an actuator in a proximal position.

As shown in FIG. 3 and FIG. 4, a slide piston 68 is sized to insert within the interior space 42 of each rigid tube 36 and slide longitudinally therein under the influence of the actuator 20, such as via a push rod 70. The slide piston 68 includes an annular piston body 72 with a plurality of circumferential protrusions 74 configured to locate the slide piston 68 radially within the interior space 42. However, the slide piston 68 also includes a circumferential groove 76 about a portion of the piston body 72 to collectively define a gap 77 within the annular sidewall 38 for receiving the compressed collapsible tube 40. Of course, in order to compress the tube against the annular sidewall 38, the slide piston 68 further includes a converging surface 78. Notably, the converging surface 78 converges to an apex 80 that is radially off center from that of the rigid tube 36 for directing the collapsible tube 40 against the tube sidewall 52.

Figure 5:
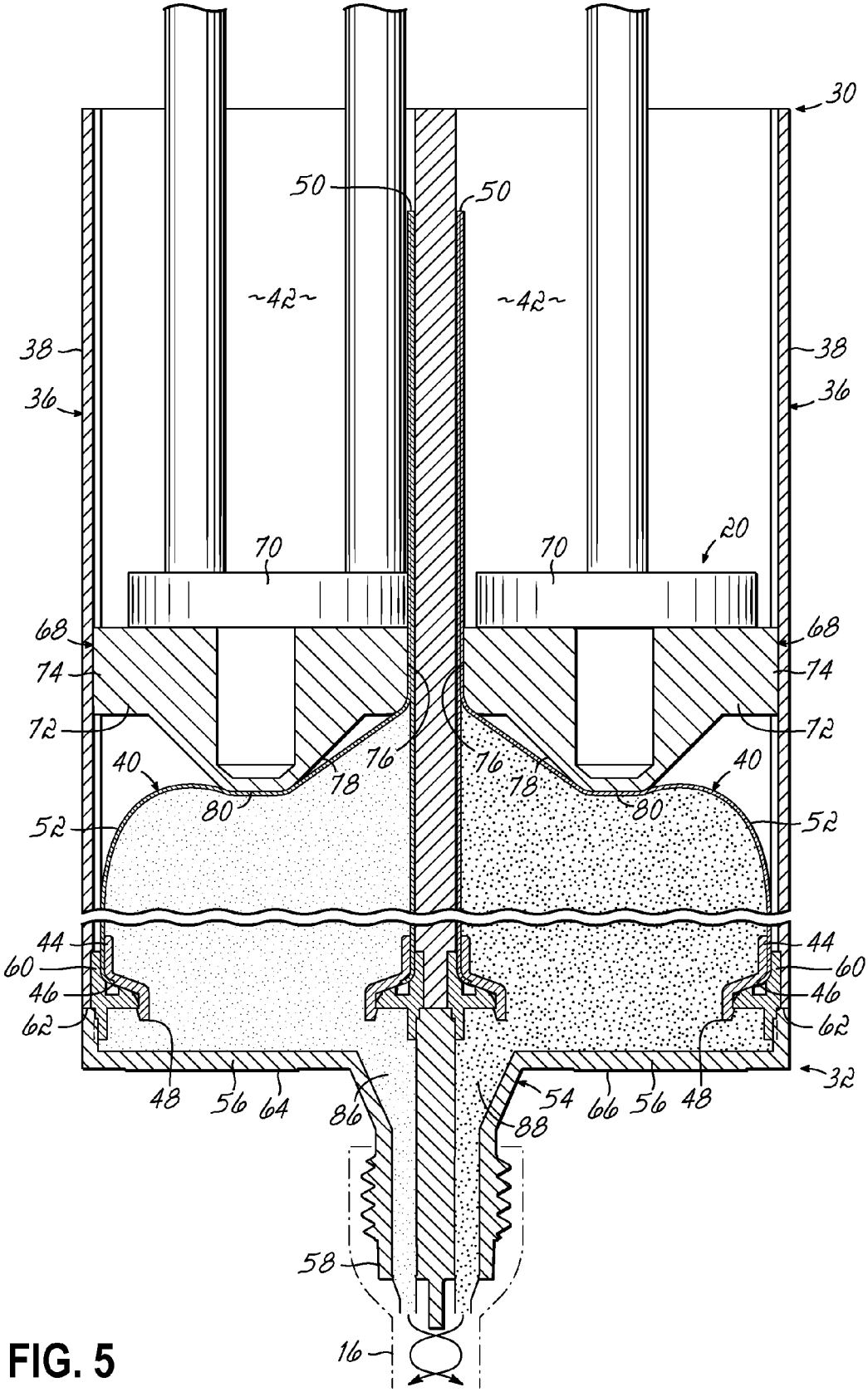
FIG. 5 is similar to FIG. 4, but shows the actuator between the proximal position and a distal position.

With respect to FIG. 4 and FIG. 5, each slide piston 68 moves distally from a proximal position to a distal position for compressing the collapsible tubes 40 and squeezing viscous fluids therefrom. To preserve the viscous fluids within the collapsible tubes 40 prior to squeezing, the opening 48 has a cover 82 for removal or puncture by the user to inhibit permeation and provide selective access to the viscous fluid therein. In addition or alternative to the removable cover 82, the outlet port 58 of the manifold 54 may include a manifold cover 84 that may similarly be removed or punctured to access the viscous fluid.

Furthermore, the manifold 54 defines a first passage 86 and second passage 88. The first passage 86 extends from one of the inlet ports 56 to the outlet port 58, whereas the second passage 88 extends from the other inlet port 56 to the outlet port 58. Thereby, the viscous fluids are independently communicated from the opening 48 and discharged into the nozzle 16 during use.

Figure 6:
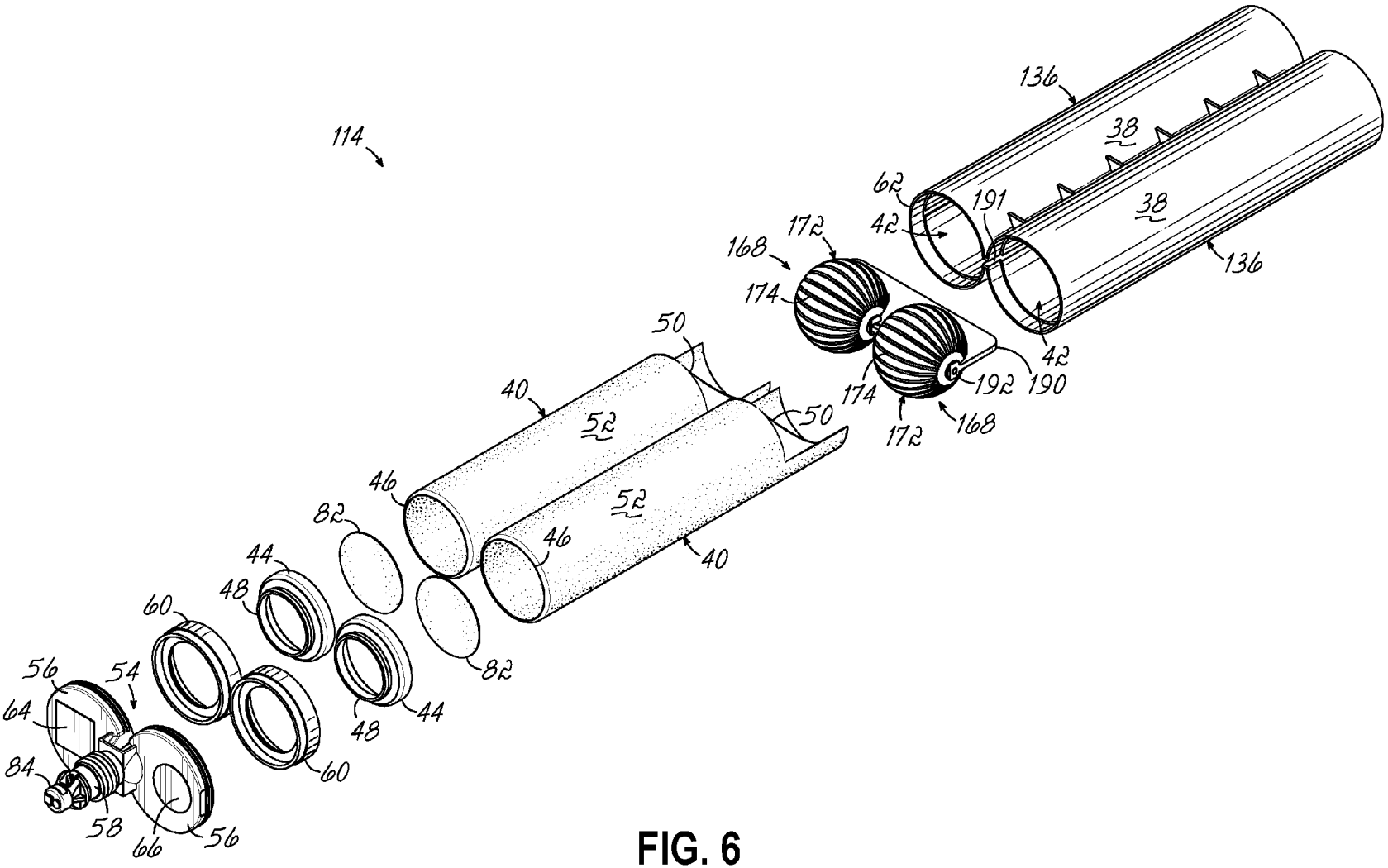
FIG. 6 is an exploded perspective view of a second embodiment of a cartridge in accordance with the invention.
Figure 7:
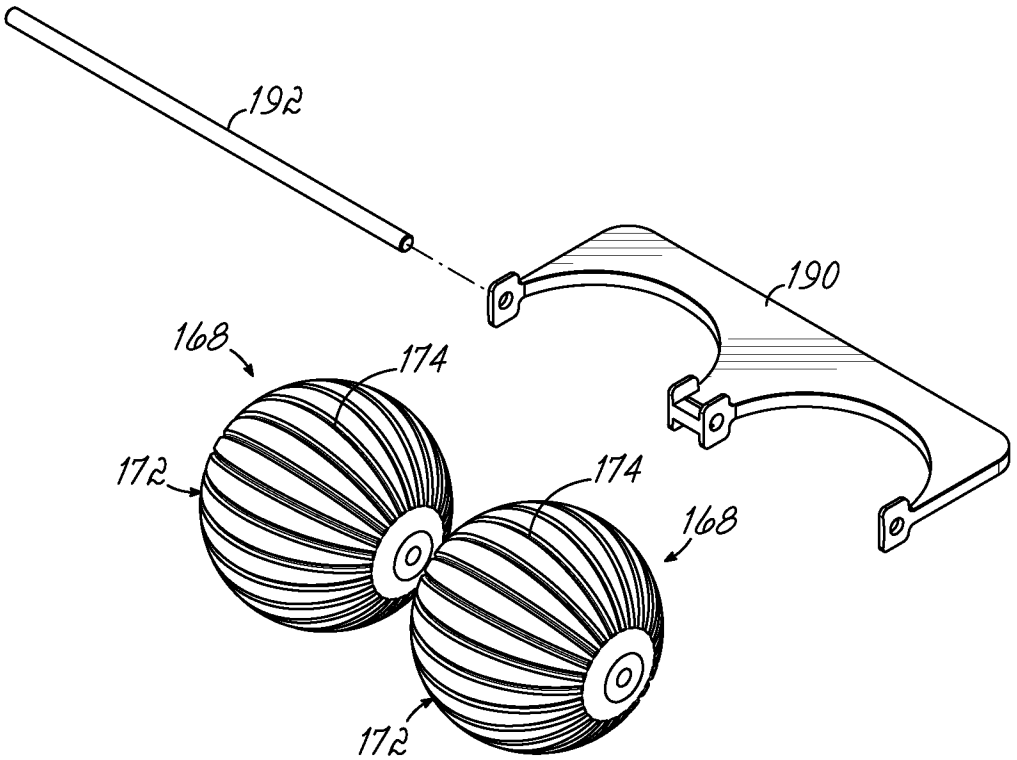
FIG. 7 is an exploded perspective view of a pair of pistons of FIG. 6.

A second exemplary embodiment of a cartridge 114 shown in FIG. 6 and FIG. 7 includes the collapsible tubes 40 within a pair of rigid tubes 136 operatively connected to the manifold 54 for dispensing viscous fluids. In this respect, like numbers indicate like features described above. Notably, rather than the slide pistons 68 (see FIG. 3) discussed above, the cartridge 114 further includes a pair of roll pistons 168 connected via a carriage 190. The carriage 190 transversely and rigidly connects one roll piston 168 to the other roll piston 168 such that longitudinal movement of one roll piston 168 is synchronized with the longitudinal movement of the other roll piston 168.

To accommodate the carriage 190, the pair of rigid tubes 136 includes a transverse slot extending from one of the rigid tubes 136 to the other rigid tube 136. As shown in an exemplary embodiment, the slot extends along an entire length of the rigid tubes 136; however, it will be appreciated that the slot may extend less than the length of the rigid tubes 136. In addition, the synchronized movement between the roll pistons 168 reduces the number of push rods 70 needed to move the roll pistons 168 to one single push rod 70. With respect to the slide pistons 68 of FIG. 3 and the roll pistons 168 of FIG. 4, it will be appreciated that the slide pistons 68 may similarly be connected via the carriage 190 and that the roll pistons 168 may be independent of each other. Thus, the slide and roll pistons 68, 168 are not intended to be limited to the exemplary embodiment shown and described herein.

Figure 8:
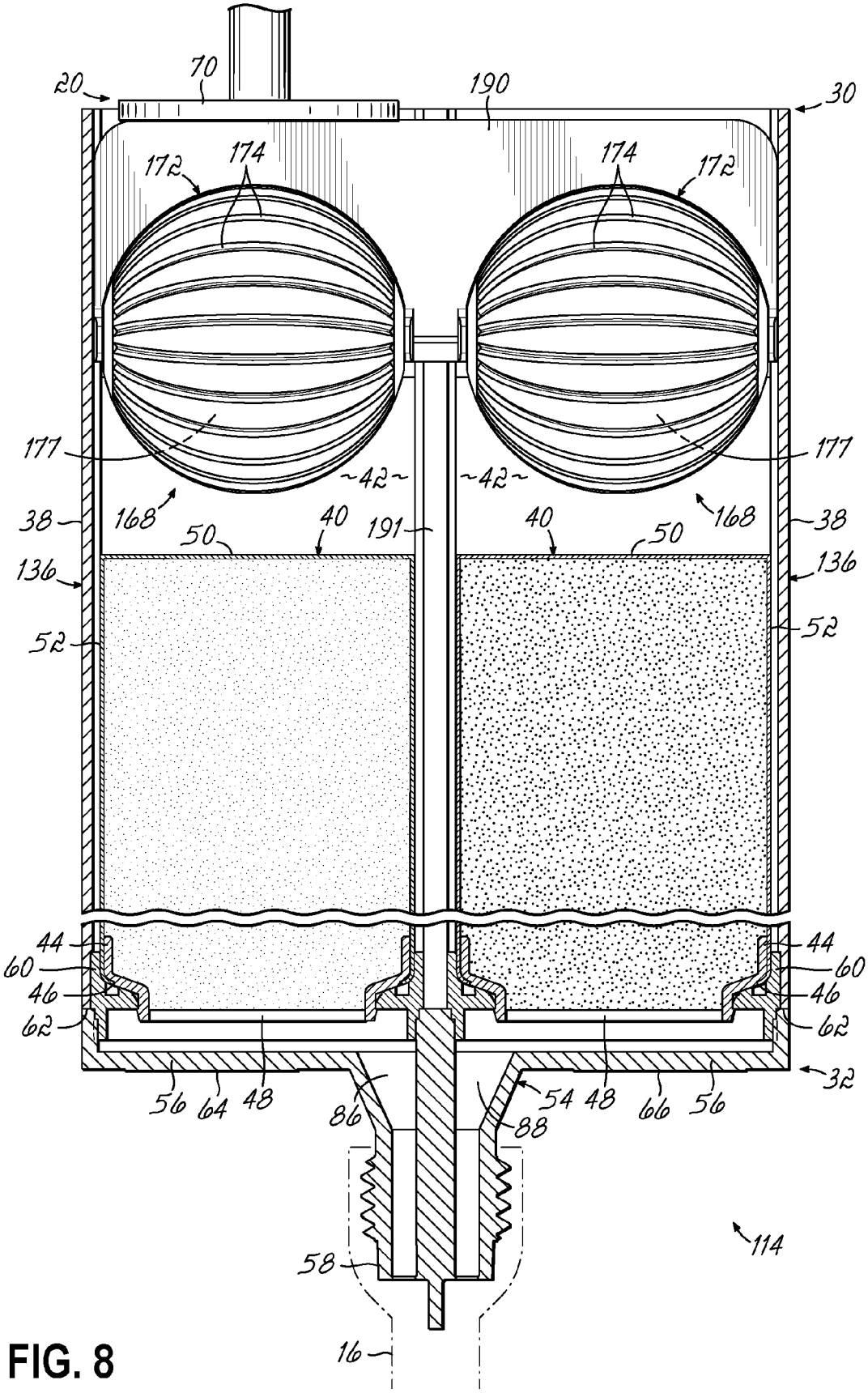
FIG. 8 is a sectional top view of the cartridge of FIG. 6 taken generally along a centerline of the cartridge with an actuator in a proximal position.
Figure 9:
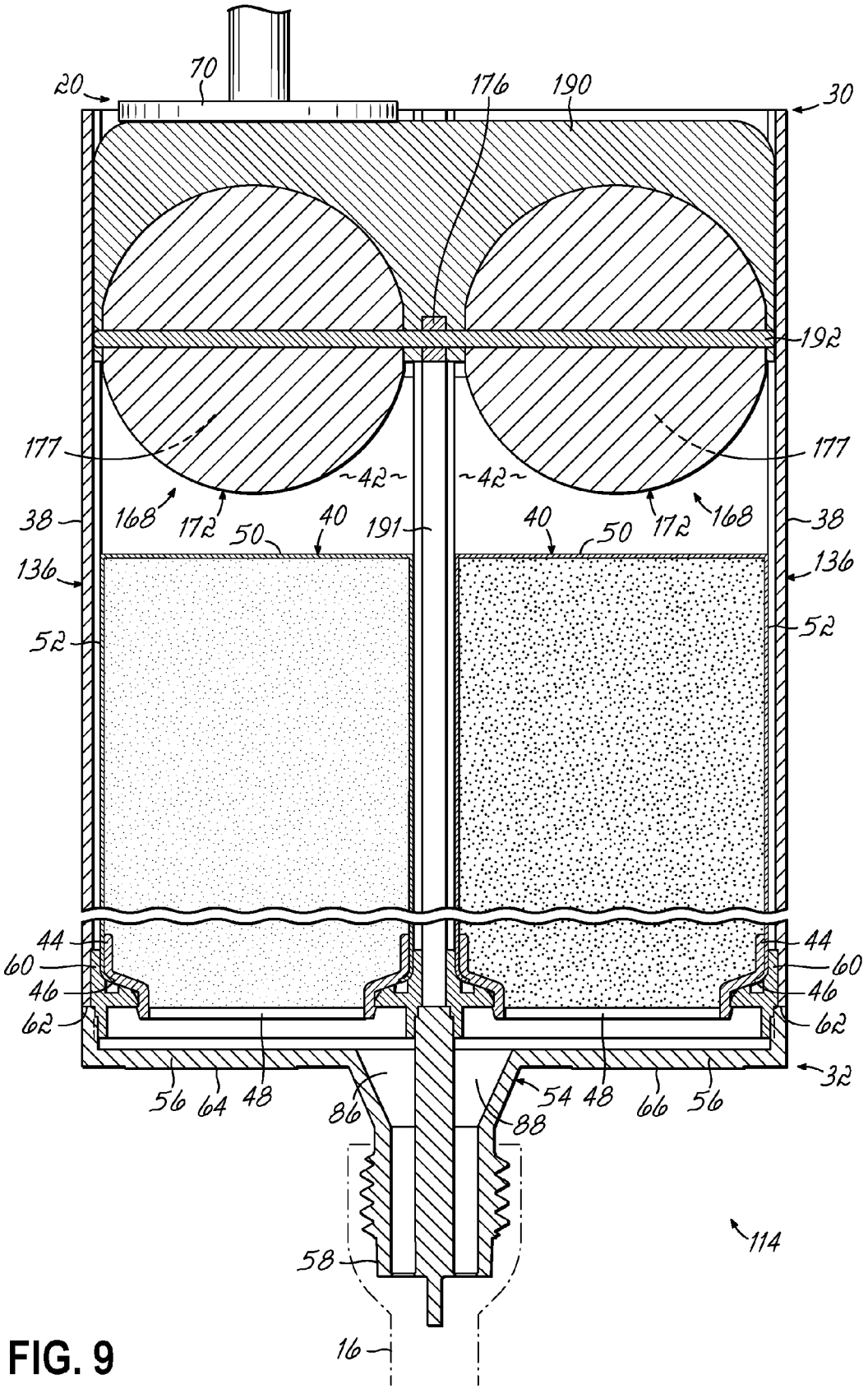
FIG. 9 is a cross-sectional view of the cartridge of FIG. 6 taken generally along the centerline of the cartridge with the actuator in the proximal position.

FIGS. 7-9 show an axle 192 extending through the carriage 190 on which each roller body 172 is rotatably mounted. Each roll piston 168 is sized to insert within the interior space 42 of each rigid tube 36 and slide longitudinally therein under the influence of the actuator 20, such as via the push rod 70. The roll piston 168 includes the roller body 172 with a plurality of transverse grooves 174 for improving engagement between the roller body 172 and the collapsible tube 40. During such engagement, the roll piston 168 collectively defines a gap 177 against the annular sidewall 38 for receiving the compressed collapsible tube 40. According to an exemplary embodiment, the roller body 172 rolls over the collapsible tube 40 to compress the tube sidewall 52 passively by the push rod 70 and the frictional engagement with the collapsible tube 40. Alternatively, the roller body 172 is operatively connected to a rotating element 176 that actively rotates the roller body 172 to roll over the collapsible tube 40. For example, as generally shown in FIG. 9, the rotating element 176 may be a drive unit or one or more gears configured to rotate the roller body 172. The rotating element 176 will travel within a lengthwise slot 191 shown in FIGS. 6 and 9. The slot 191 also accommodates carriage plate 190 to travel lengthwise as the tubes 40 are collapsed.

Figure 10:
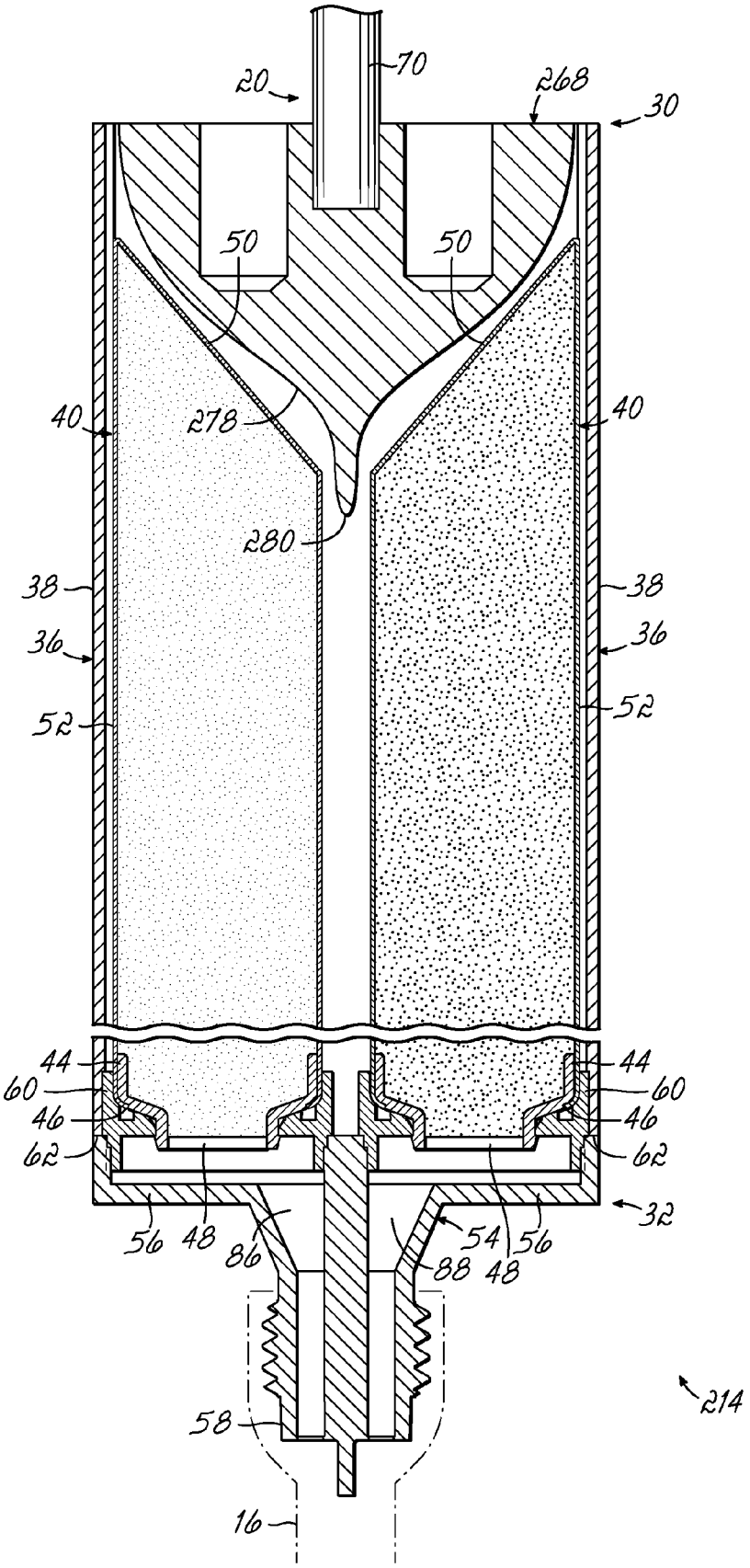
FIG. 10 is a cross-sectional view of a third embodiment of a cartridge in accordance with the invention taken generally along a centerline of the cartridge with an actuator in a proximal position.

FIG. 10 shows a third alternative embodiment of a cartridge 214 having a pair of collapsible tubes 40 positioned side-by-side within the interior space 42 of a single rigid tube 36. Accordingly, like numbers indicate like features described above. The cartridge 214 includes a wedge piston 268 sized to insert within the interior space 42 of the rigid tube 36 and slide longitudinally therein under the influence of the actuator 20, such as via the push rod 70. The wedge piston 268 includes a converging surface 278 that converges to an apex 280 that is radially aligned with the rigid tube 36 for simultaneously directing the pair of collapsible tubes 40 opposite from one another and against the annular sidewall 38.

With reference to FIGS. 1-5, in use, the applicator 10 moves an actuator 20 through the interior space 42 along the length of the collapsible tubes 40. In turn, a portion of the tube sidewall 52 is compressed against the opposite portion of the tube sidewall 52 and the tube sidewall 52 flattens together. The flattened portion of the collapsible tube 40 is received within a gap 77 as the slide piston 68 moves from the distal position toward the proximal position. Accordingly, the viscous fluid contained within each collapsible tube 40 is squeezed therefrom and into respective first and second channels 86, 88 of the manifold 54. The viscous fluids discharge from the outlet port 58 and into the nozzle 16 in the form of the static mixer. Thus, the viscous liquids are mixed and dispensed from the static mixer/nozzle 16.

While the above description refers to the cartridge 14 the cartridge 114 shown in FIGS. 6-9 may be similarly used. However, the roller pistons 168 generally roll against the collapsible tube 40 to squeeze viscous fluid therefrom. Also, the above written description similarly applies to the cartridge 214 shown in FIG. 10 and may be similarly used. However, the wedge piston 268 simultaneously squeezes a pair of the collapsible tubes 40 oppositely from each other within one rigid tube 36.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. For example, the exemplary embodiments described herein show collapsible tubes of similar dimensions. However, it will be appreciated that the collapsible tubes 40 may be generally any volume and used in any combination with such volumes. The invention in its broader aspects is therefore not limited to the specific details, representative apparatus and method and illustrative examples shown and described. Accordingly, departures may be from such details without departing from the scope of the general inventive concept.

What is claimed is:

1. An applicator for dispensing a first viscous fluid, the applicator comprising:

a support structure;

a cartridge including a first wall and a first interior space, the first interior space receiving a first collapsible tube holding the first viscous fluid, said first collapsible tube formed from a flexible material and having a length with generally opposite sidewall portions defined along said length, said first collapsible tube positioned against the first wall and further including a closed end and a dispensing end; and an actuator operatively coupled to said support structure, said actuator movable through said first interior space of said cartridge along said length of said first collapsible tube and against one of said generally opposite sidewall portions to compress said one sidewall portion against said other sidewall portion and said first wall along said length and squeeze the first viscous fluid from said dispensing end, wherein a gap is defined by said actuator and said first wall for receiving said compressed collapsible tube therebetween.

2. The applicator of claim 1, wherein said generally opposite sidewall portions have a uniform thickness, said uniform thickness being greater than 0.003 inches.

3. The applicator of claim 1, wherein said cartridge further comprises:

a first rigid tube having said first wall and defining said first interior space sized for receiving said first collapsible tube therein, said first rigid tube having a first distal end and a first proximal end.

4. The applicator of claim 3, wherein said cartridge further comprises:

a first piston sized for insertion into said first interior space, said first piston movably positioned within said first interior space from said first proximal end toward said first distal end and configured to flatten said one generally opposite sidewall portion against said other sidewall portion.

5. The applicator of claim 4, wherein the gap is defined by said first piston and said first rigid tube, and said first piston selectively slides over said flattened collapsible tube.

6. The applicator of claim 4 wherein the gap is defined by said first piston and said first rigid tube, and at least a portion of said first piston selectively rolls over said flattened collapsible tube.

7. The applicator of claim 4, wherein the cartridge further includes a second wall and a second interior space, said second interior space receiving a second collapsible tube holding a second viscous fluid, said second collapsible tube formed from a flexible material and having a length with generally opposite sidewall portions defined along said length, said second collapsible tube positioned against the second wall and further including a closed end and a dispensing end.

8. The applicator of claim 7, further comprising a static mixer operatively connected to the cartridge for mixing the first and second viscous fluids.

9. The applicator of claim 7, wherein said cartridge further comprises:

a second rigid tube having said second wall and defining said second interior space sized for receiving said second collapsible tube therein, said second rigid tube having a second distal end and a second proximal end; and a second piston sized for insertion into said second interior space, said second piston movably positioned within said second interior space from said second proximal end toward said second distal end and configured to flatten said one generally opposite sidewall portion against said other sidewall portion, wherein said first and second rigid tubes are positioned side-by-side and rigidly secured together.

10. The applicator of claim 9, wherein said cartridge further comprises:

a slot extending from said first rigid tube to said second rigid tube and extending at least partially along said length of said first and second rigid tube; and a carriage member connecting said first piston to said second piston through said slot for synchronizing movement of said first and second pistons.

11. A cartridge for holding a first viscous fluid, the cartridge comprising:

a first wall and a first interior space, the first interior space receiving a first collapsible tube holding the first viscous fluid, said first collapsible tube formed from a flexible material and having a length with generally opposite sidewall portions defined along said length, said first collapsible tube positioned against the first wall and further including a closed end and a dispensing end;

a first rigid tube having said first wall and defining said first interior space sized for receiving said first collapsible tube therein, said first rigid tube having a first distal end and a first proximal end; and a first piston sized for insertion into said first interior space, said first piston movably positioned within said first interior space from said first proximal end toward said first distal end and configured to flatten one sidewall portion against said other sidewall portion and said first wall, wherein a gap is defined by said first piston and said first rigid tube for receiving said flattened collapsible tube therebetween.

12. The cartridge of claim 11, wherein at least a portion of said first piston selectively rolls over said flattened collapsible tube.

13. The cartridge of claim 11, further comprising:

second wall and a second interior space, said second interior space receiving a second collapsible tube holding a second viscous fluid, said second collapsible tube formed from a flexible material and having a length with generally opposite sidewall portions defined along said length, said second collapsible tube positioned against the second wall and further including a closed end and a dispensing end;

a second rigid tube having said second wall and defining said second interior space sized for receiving said second collapsible tube therein, said second rigid tube having a second distal end and a second proximal end; and a second piston sized for insertion into said second interior space, said second piston movably positioned within said second interior space from said second proximal end toward said second distal end and configured to flatten one sidewall portion against said other sidewall portion, wherein said first and second rigid tubes are positioned side-by-side and rigidly secured together.

14. The cartridge of claim 13, further comprising:

a slot extending from said first rigid tube to said second rigid tube and extending at least partially along said length of said first and second rigid tube; and a carriage member connecting said first piston to said second piston through said slot for synchronizing movement of said first and second pistons.

15. A method of dispensing a first viscous fluid from an applicator having a cartridge, the cartridge including a first collapsible tube within a first interior space of a first rigid tube, the first rigid tube having a first wall, and the first collapsible tube having a first sidewall and holding the first viscous fluid, the method comprising;

moving an actuator through the first interior space of the cartridge along a length of the first collapsible tube;

compressing a portion of the first sidewall against an opposite portion of the first sidewall supported by the first wall to flatten at least a portion of the first collapsible tube against the first wall;

receiving a flattened portion of the first collapsible tube within a first gap defined by the actuator and the first wall within the first interior space; and squeezing the first viscous fluid from a first dispensing end of the first collapsible tube.

16. The method of claim 15, further comprising:

sliding a first piston within the first interior space against the first collapsible tube to force the first collapsible tube against the first wall.

17. The method of claim 16, further comprising:

rolling at least a portion of the first piston within the first interior space against the first collapsible tube to force the first collapsible tube against the first wall.

18. The method of claim 15 wherein the cartridge includes a second collapsible tube within a second interior space of a second rigid tube, the second rigid tube having a second wall, and the second collapsible tube having a second sidewall and holding a second viscous fluid, and the method further comprises:

moving another actuator through the second interior space of the cartridge along a length of the second collapsible tube;

compressing a portion of the second sidewall against an opposite portion of the second sidewall supported by the second wall to flatten at least a portion of the second collapsible tube;

receiving a flattened portion of the second collapsible tube within a second gap defined by the other actuator and the second wall within the second interior space; and squeezing the second viscous fluid from a second dispensing end of the second collapsible tube.

19. The method of claim 18, wherein the first and second viscous fluids are first and second reactive viscous fluids, and the method further comprises:

mixing the first and second reactive viscous fluids within a static mixer; and dispensing the mixed viscous reactive fluids from the static mixer.

* * * * *